US005152230A

United States Patent [19]

Licari

[11] Patent Number: 5,152,230

[45] Date of Patent: Oct. 6, 1992

[54] JOINING MEANS FOR SECURING ARTICLES TOGETHER

[76] Inventor: Yaffa Licari, 875 Ocean Ave., Elberon, N.J. 07740

[21] Appl. No.: 506,285

[22] Filed: Jun. 20, 1983

[51] Int. Cl.[5] ..... A47B 3/06

[52] U.S. Cl. ..... 108/153; 108/111; 248/231.8

[58] Field of Search ..... 108/153, 111; 46/124, 46/125; 248/231.8, 315, 304

[56] References Cited

U.S. PATENT DOCUMENTS

| | | | |
|---|---|---|---|
| 2,569,555 | 10/1951 | Chanslor et al. | 108/111 X |
| 2,737,755 | 3/1956 | Schigas . | |
| 2,754,029 | 7/1956 | Macrey, Sr. | 248/231.8 X |
| 2,959,888 | 11/1960 | Noble . | |
| 3,080,202 | 3/1963 | Franzene | 108/119 X |
| 3,194,526 | 7/1965 | Lemmond | 248/231.8 |
| 3,221,439 | 12/1965 | Schaper . | |
| 3,295,471 | 1/1967 | Cook | 108/111 |
| 3,300,168 | 1/1967 | Gaudino | 248/231.8 X |
| 3,381,824 | 5/1968 | Blumenschein | 248/315 X |
| 3,392,480 | 7/1968 | Stubbmann . | |
| 3,550,311 | 12/1970 | Fouquart . | |
| 3,682,323 | 8/1972 | Bergquist et al. | 211/74 |
| 3,836,106 | 9/1974 | Gray | 248/231.8 X |
| 3,909,564 | 9/1972 | Miller et al. | 108/111 |
| 3,927,489 | 12/1975 | Bernstein . | |
| 4,078,793 | 3/1978 | Allen | 273/1 A |
| 4,103,969 | 8/1978 | Glessner | 108/111 X |
| 4,193,572 | 3/1980 | Horiuchi et al. | 248/231.8 X |
| 4,352,255 | 10/1982 | Warehime . | |

*Primary Examiner*—Kenneth Downey

[57] ABSTRACT

Joining means for securing articles together comprising a plastic member provided with a substantially vertically extending recess, i.e. one whose throat is at the base portion of the member; the throat portion being narrower than the remainder of the recess and utilitarian means to which the joining member is attached either in the form of vertical walls in such manner that joining members form, in effect, side walls providing a self-sustaining structure or in the form of a member which supports other articles such as trays, hooks, rings, and the like, with which the joining member is integrally molded.

19 Claims, 2 Drawing Sheets

JOINING MEANS FOR SECURING ARTICLES TOGETHER

BACKGROUND OF THE INVENTION

Heretofore there have been many proposals providing connectors. Among them are, of course, tongue and groove connectors, screws and bolts, nails and the like. In addition, proposals have been made to use connectors comprising clutching elements or grippers having narrow slots leading to a central opening which is wider than the slots to accomplish a "snap on" performed their function satisfactorily, in many instances the resultant structure involved costly labor and production procedures and expensive shipping costs.

The need has remained unfulfilled for the provision, in a labor and cost saving way, of specific joining means which become in effect a wall of a structural arrangement while the structure can be shipped in collapsed or "knock-down" condition and which are molded integrally with a utilitarian member for the support of other articles.

SUMMARY OF THE INVENTION

The invention presents a unique structural concept in which the connector is either an integral part of a utilitarian structure or is the basic means for providing a self-supporting and self-sustaining vertically extending structural arrangement. In the latter arrangement, two or more vertically extending side walls are joined together by the joining means, which means are so constructed as to function as walls for making the unit self-supporting and self-sustaining.

The joining means themselves comprise a preferably arcuate member which is provided with a recess whose throat portion is narrower than the remainder of the recess. This arcuate element is molded integrally with the utilitarian functional structure which is to be attached to a support. The size of the arcuate element may vary from one which is relatively large in dimension to one which is mini or micro sized. The joining element is an integral part of the structure which is to be attached to another unit and because of its construction may not be inadvertently detached. In addition, its integral nature eliminates any requirement for a laborious operation to attach the joining means to the structure itself or to form a self-sustaining structural arrangement.

In one form of the invention, the joining means are rotatable over the surface perimeter of the walls which will comprise the self-supporting structural arrangement. As a consequence, an advantageous concept is therefore provided in that the parts to be joined together may be shipped in partly assembled but "knock-down" form. This is accomplished, for example, by assembling the joining means to the perimeter of one of two sides of each of the walls which are later to be vertically assembled as a selfsupporting unit. As a result of the rotatable feature, the joining means will move in an arc around the perimeter in such fashion that the walls to be joined will abut each other for shipment to save space with the consequent great saving in shipping charges. In addition, the ultimate consumer is provided with immediate knowledge as to the method of assembly because two sides of the walls are already joined together and all that is required is joinder of the two remaining sides with additional joining means which are shipped together with the walls.

The following drawings and description of various embodiments of the invention are not in any way intended to be a imitation upon the scope thereof, but are merely for illustrative purposes to facilitate an understanding of the invention.

DETAILED DESCRIPTION OF THE INVENTION

Figure 1:
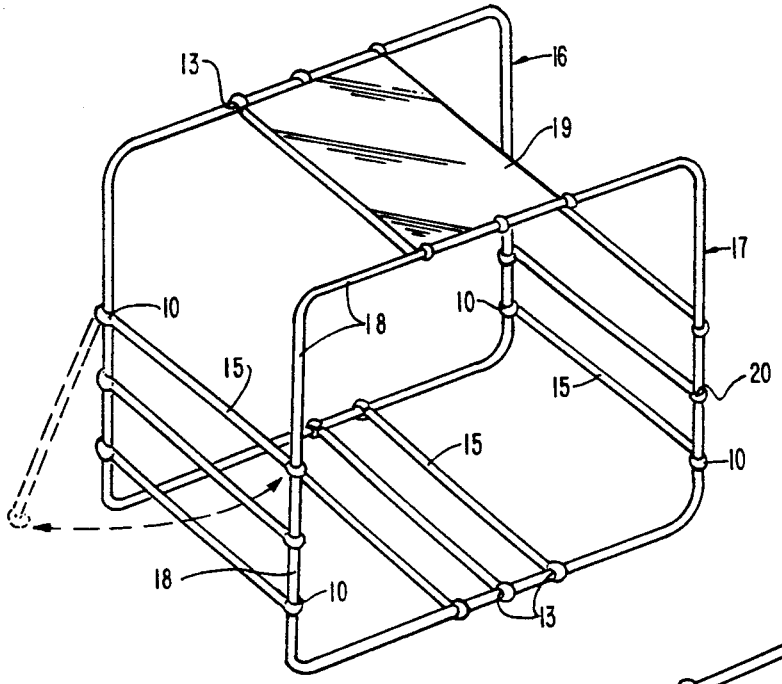
FIG. 1 is a perspective view of two walls connected by joining means disposed around the sides of the walls to make the resulting structure self-sustaining and also showing one joining means swung outwardly as in the form of an access door.

The present invention provides a joining means 10 which is singularly adapted for multiple use. The joining means 10 as shown in FIG. 1 is a connector between two vertically extending walls and also provides the means for accomplishing a self-supporting structural arrangement. The joining means 10 are preferably provided with an arcuate exterior 11. However, while the exterior is in rounded or arcuate form it will be understood that this exterior may be rectangular, triangular, frustroconical, or any other suitable form. The joining means 10 is provided with a recess 12 whose insertion throat 13 is more restricted than the remainder 14 of the recess (cf. FIG. 9). The throat 13 is subject to limited expansion under pressure so that when it is forced onto another accommodating piece the throat 13 expands to accept the piece and, thereafter, being endowed with memory designed within elastic limits of the material, the throat returns to its original size when the pressure is released. It is essential, therefore, in accordance with the present invention that the joining means 10 be made of suitable plastic so that it may be molded integrally with the remainder of the structure as a one piece integral unit.

Figure 2:
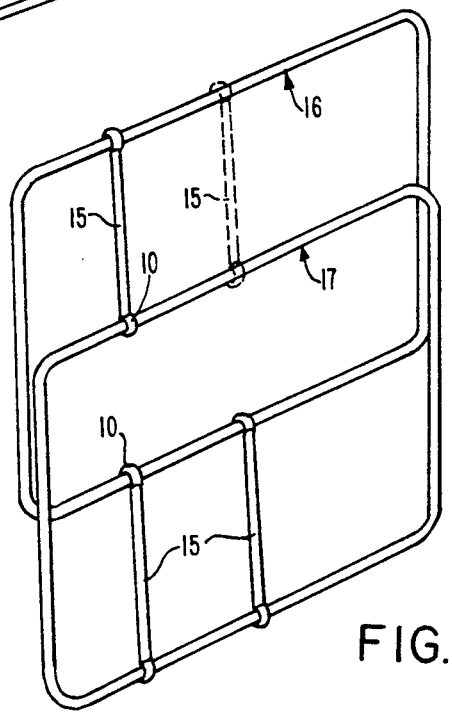
FIG. 2 is a perspective view of the walls of FIG. 1 in collapsed form with the joining means disposed on the edge of the walls which are in abutting relationship.

As shown in FIGS. 1 and 2, the joining means 10 are formed integral with a round girth profile or cross section bar 25. The round profile member is used as the supporting means for two vertically disposed walls 16 and 17 whose perimeters comprise integrally molded bars 18 which are round in profile or cross section and are adapted and sized as joining portions insertable through the throat 13 so as to fit within the recess 12 of the joining means 10. The joining means 10 may be formed integrally with a solid plate 19 which, as illustrated in FIG. 1 is provided with joining means at each corner. The plate 19 helps to maintain and support articles thereon and also serve as a portion of the means for making the entire structure self-supporting and self-sustaining. This invention in part resides in forming this self-sustaining structure with the joining means 10 themselves forming in effect walls of the ultimate structural unit.

To assemble the structure, the joining means 10 are secured adjacent the edges of the round cross section bars 18 of the rectangular units or frames 16 and 17. To accomplish this attachment the joining connector 10 is first placed over a bar 18 and then the connector is pressed downwardly to expand the throat 13 which rides over the bar for engagement within the wider portion 14 of the recess 12. This same attaching procedure is accomplished on the other portion of the perimeter bar or frame member 18.

The bar or frame member 18 will not inadvertently become detached from the joining means 10 because the recess is so constructed that after the bar 18, which is of round cross section, is past the throat 13 into the wider portion 14 the throat, having a memory, constricts around the lower portion of the round girth profile bar or frame member 18 and may not be dislodged except upon the insertion of substantially forceful pressure lifting the joining means away from the frames.

As illustrated in FIG. 1, the joining means 10 are rotatable around the bars 18. Therefore, the joining means may act as an access door by removing the joining means from one of the units 17 and swinging it, as shown in dotted lines in FIG. 2, to the position illustrated parallel to or beyond the surface plane of unit 16. As a consequence, if unit 16 was joined near the base, or at any point intermediate, with an integral shelf (not shown), access to such shelf would be easily obtainable by moving the joining means around the access provided by one of the bars, as illustrated in FIG. 2.

The joining means are so constructed that they may slide along the bars 18 to any desired position. Thus, the attachment may be made at one place and the joining means then moved to another position, if desired.

FIG. 2 illustrates a very distinct advantage obtained by the structure of the present invention. As shown, the units 16 and 17 are joined together on two sides by the joining means 10 in the form of arcuate bulbous members 11 (cf. FIG. 8) provided with recesses. 12 and 20 (cf. FIG. 1) which engage the round cross section bars 18 located at the upper and lower sides of these units. The ability of the joining means to pivot or rotate at least partially around the bars 18 enables the units 16 and 17 to be moved to an abutting relation for shipment without disturbing the engagement between the joining means 10 and the perimeter bars 18 on each of the units. In this "collapsed" position the units may be shipped efficiently and economically accompanied, of course, by other similar joining means to be positioned on the other sides of the frame when erecting the structure. When the consumer receives the units in this collapsed fashion, it is only necessary to move the unit 17 arcuately upward until it is in dimensionally parallel relation to unit 16. At this point, the joining means will extend their full length between the upper sides of the units 16 and 17 and the lower sides of the units 16 and 17 and it becomes obvious to the consumer that to provide a self-sustaining structure it is only necessary to place the additional joining means between the other sides, which in this instance would be the left and right sides of the units. This novel "collapsing" feature accomplishable with the joining means remaining in place on the units is the result of the unique structural arrangement provided by the joining elements 10 and the cooperating walls 16 and 17.

The invention also resides in the provision of joining means molded integrally with utilitarian members. This concept enables the provision of many useful accessories. The joining means which are integrally molded with the utilitarian members are uniquely constructed in that the recess therein extends substantially vertically with relation to the utilitarian member whether the member is horizontally or vertically disposed. There are many variations as illustrated by the figures in the drawings. These depictions are, however, merely a portion of the different utilitarian configurations with which the joining means may be integrally molded for attachment to other structures.

Figure 3:
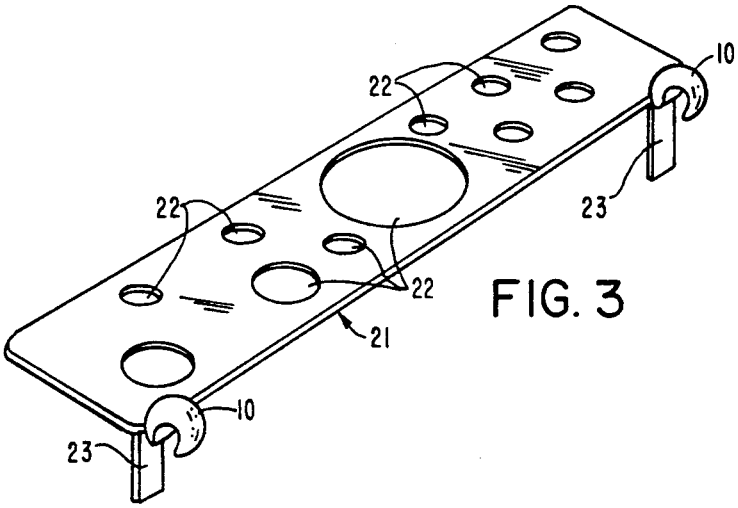
FIG. 3 is a perspective view of a tray with two joining means disposed on an edge of the tray for attachment to another

Shown in FIG. 3 is another embodiment of the present invention. As illustrated, the connectors or joining means 10 are integral with a tray or tool holder 21 so as to form a one piece integral unit therewith which may then be attached to any suitably configured piece of furniture, shelving, or the like. The apertures 22 in the tray or tool holder 21 may be different sizes, as illustrated, for the accommodation of different sized tools, glasses, cups and pitchers. A dependent stabilizer 23 is also molded integrally with the tray 21 and prevents it from tipping.

Figure 4:
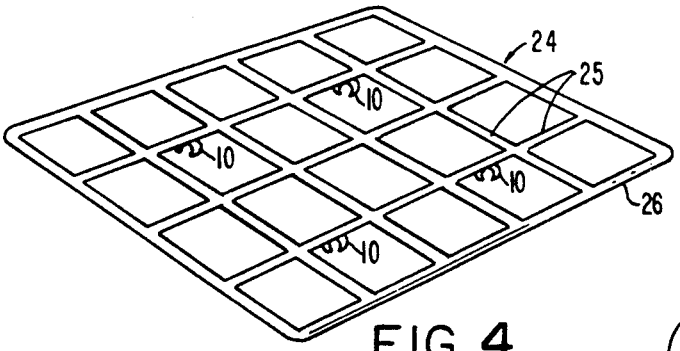
FIG. 4 is a perspective view of a shelf with the joining means disposed interiorly of the edges of the shelf for attachment to structural members which will support the shelf.

FIG. 4 illustrates another embodiment of the present invention. In this construction a table top 24 comprises a lattice of cross members 25. The joining means 10 are molded integrally to cross members 25 disposed within the perimeter 26 of the table top 24, as shown, thereby forming a one piece integral unit comprising the joining means 10 and the table top 24. The table top 24 may be disposed on the frame of units 16 and 17, illustrated in FIG. 1, and provides an appropriate support for magazines, books, trays, or any other such item. Thus, as shown in FIG. 4, the lattice of crossmembers 25 has a top side and a bottom side bounded by the perimeter 26, and the joining means 10 depend from the bottom side of such lattice or table to 24 and are disposed inwardly of the perimeter 26 and are integrally connected at their corresponding body portions directly locally to the crossmembers 25 to form the one piece integral unit. In particular, the joining means 10 are arranged in a plurality of rows of aligned joining means in spaced relation along the bottom side of the lattice or table top 24 as shown in FIG. 3.

Figure 5:
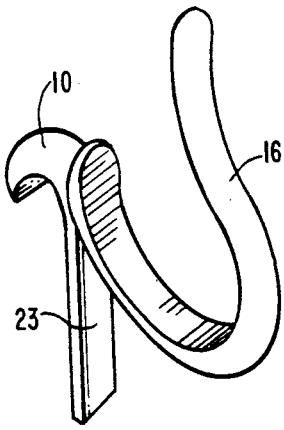
FIG. 5 is a perspective view of the joining means integrally molded with a hook member.

FIG. 5 illustrates still another of the multiple uses for the concept of the present invention. As shown, the connector 10 is molded integrally with a hook member 16, thereby forming a one piece integral unit therewith. The hook is illustrated as a single vertically extending bar. However, the hook may be in the form of a vertically extending inverted U-shaped member adjacent the joining means. The term "hook" as used herein is intended to apply to all such configurations. As a consequence, provision is made for a shoe rack and for hanging hats, clothes or similar items which may be joined on an appropriately constructed support to which the connector or joining means 10 is attached. In this embodiment a dependent stabilizer 23 is also utilized to offset the weight of the items carried by the hook 16 and prevent any possibility of the unit tipping and falling.

Figure 6:
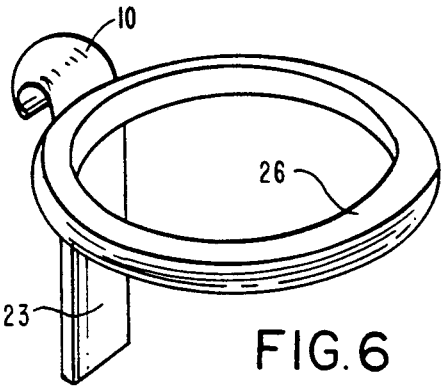
FIG. 6 is a perspective view of the joining means integrally molded with a horizontally extending ring.

FIG. 6 provides another illustrative example of the multifaceted nature of the structure accomplishable with the use of the present invention. Here, the joining means 10 is produced integrally with a horizontally disposed ring 26 so as to form a one piece integral unit therewith. This may accommodate and support glasses, or the like, and, of course, may be secured to any appropriately configured structure such as the tubular arm of a chair, or the like.

A dependent bar 23 is also provided which is integrally molded with this unit. The bar 23 serves to offset the weight of the glass, cup or similar item carried in the ring 26 and prevents the unit from tipping or falling. Thus, there is provided a safe and efficient structure for holding glasses, cups and the like in a balanced condition.

Figure 7:
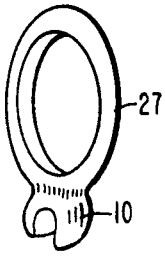
FIG. 7 is a perspective view of the joining means integrally molded with a vertically extending ring.

Illustrated in FIG. 7 is the joining means 10 molded integrally with a vertically disposed ring 27 for likewise forming a one piece integral unit therewith. The embodiment provides a simple and practical structure for holding towels and other articles which can be draped through this ring after the unit is secured to a cross bar as, for example, any tubular bar conventionally located in the bath or kitchen.

Figure 8:
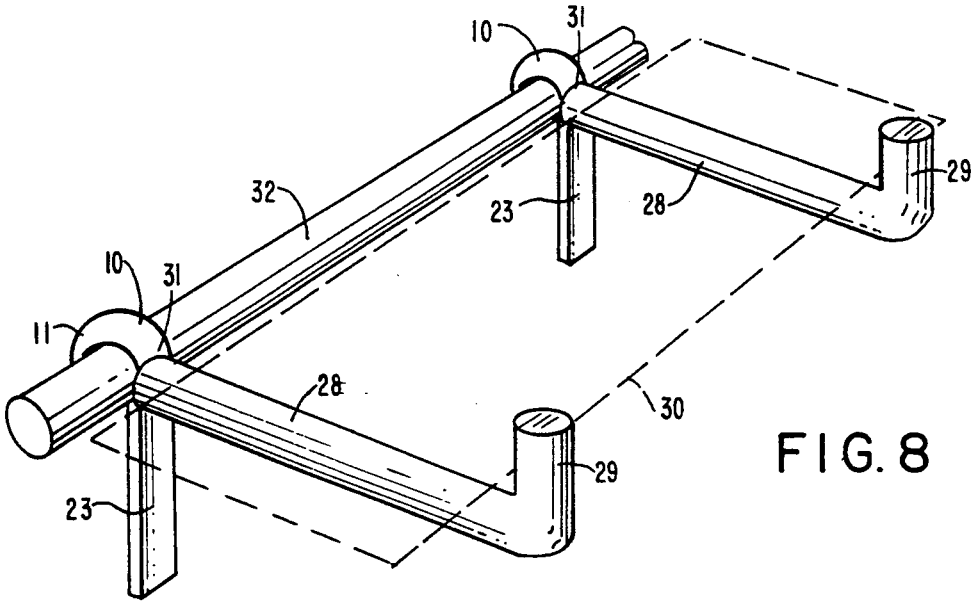
FIG. 8 is a perspective view of the joining means provided with a horizontally disposed bar for accommodating and maintaining a shelf shown in dotted lines.

FIG. 8 is an illustration of another example of the versatility of the joining means and accompanying structure. As shown, the joining means 10 is integrally molded with a laterally extending support bar 28 for likewise forming a one piece integral unit therewith. A flange 29 is provided at the outer extremity of the bar. The resulting structure, together with a similar structure spaced therefrom laterally, as shown, will form a support for a shelf 30 shown in dotted lines. The shelf 30 is maintained within the confines of the upwardly directed flange 29 and the upper portion 31 of the arcuate exterior 11 of the joining means 10. A dependent stabilizer 23 is also used in this embodiment of the invention to prevent tilting of the unit around the supporting bar 32. Of course, the length of the support shelf may be as extensive as the number of spaced units utilized when the units are constructed as illustrated.

Thus, it is clear from FIGS. 3, 5, 6 and 8 that the corresponding body portion of the joining means 10, the generally laterally extending utilitarian support member such as the tray, the hook member, the ring or the support bar, and the stabilizer or bar 23, in each instance, are inherently integrally interconnected at a substantially common interconnection directly locally therebetween for forming a one piece integral three member unit (FIGS. 5, 6 and 8) or five member unit (FIG. 3), as the case may be, permitting the utilitarian support member to be joined in stabilized condition to a structure, such as the longitudinally extending supporting bar 32 as shown in FIG. 8, for supporting other articles.

Accordingly, in the case of the five member unit as shown in FIG. 3, the utilitarian support member such as a horizontal apertured tray 21 has a longitudinal extent and corresponding longitudinal end portions and a lateral or crosswise extent and corresponding lateral edge portions, and longitudinally extends between the spaced joining means 10 and is integrally connected at its corresponding end portions directly to the body portions of the spaced joining means 10, and further generally laterally extends crosswise of its longitudinal extent and of the joining means 10. Hence, the longitudinally spaced stabilizers or bars 23 which depend from the tray 21 are integrally connected directly locally to the tray end portions in proximity to the body portions of the joining means 10 thereat and in laterally spaced relation to one of the lateral edge portions of the tray 21.

In particular, the tray 21 is provided with four corner portions at the marginal junctions between the longitudinal end portions and lateral edge portions thereof, and the corresponding direct local interconnections of the joining means 10, stabilizers or bars 23 and tray are disposed at two such corner portions adjacent one of the lateral edge portions as shown in FIG. 3.

Figure 9:
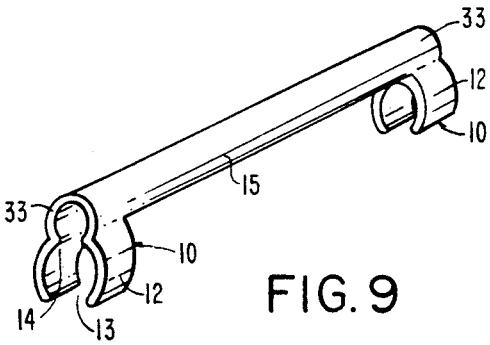
FIG. 9 is a perspective view of the joining means integrally molded on both sides of a tubular arm or bar with two recesses of different dimensions for attachment to round cross sectional members of varied circumferential dimensions.

As shown in FIG. 9, the joining means 10 themselves may have a unique form. In this form the joining means comprise stepped first and second recesses 12 and 33 formed integral with a round profile bar 15, again providing a one piece integral unit therewith. The first recess 12 has a throat portion 13 which is more restricted than the remainder 14 of the recess. The recess 33 is similar in shape but of lesser dimension than the first recess 12. Thus, the joining means 10 may be used to accommodate perimeter bars of different dimensions. In the event there is a perimeter bar of substantially the same dimension as the first recess 12, it will be accommodated and engaged within this recess. In the event there is a perimeter bar of smaller dimension, i.e. substantially the dimension of the second recess 33, the bar will easily pass through the first recess 12 and be accommodated and engaged within the second recess 33. It is clear from FIG. 9 that the stepped recesses 12 and 33 communicate with each other and have corresponding substantially parallel longitudinal axes extending in a direction crosswise of their substantially vertically extending stepped direction, whereby a relatively small sized perimeter bar or longitudinal bar on one article unit may be engaged in the smaller recess or recesses 33 along the common longitudinal axis of such recesses 33 and in substantially parallel relation to the common longitudinal axis of the first or larger recesses 12, and a relatively large sized perimetric bar or longitudinal bar on another article unit may be engaged in the larger recess or recesses 12 along the common longitudinal axis of such recesses 12 and in substantially parallel relation to the common longitudinal axis of the smaller recesses 33, such that when one such bar is engaged in the recess or recesses 33 and simultaneously another such bar is engaged in the recess or recesses 12 the bars will be inherently accommodated without interference with each other.

The joining means are not subject to any limitation as to size, except that which is determined by practicality. The joining means, therefore may be of standard size, mini size, or even relatively micro size.

The invention contemplates the use of "joining means" of a known form but in conjunction with utilitarian means for supporting other articles. The joining means are connected with the utilitarian means to form a self-sustaining structural arrangement which requires the presence of the joining means and the utilitarian means or the joining means are integrally molded with the utilitarian means.

Furthermore, the present joining means, while illustrated in arcuate form as to its outer circumference, may be of any other outer configuration, such as rectangular, triangular, etc.

In addition, the joining means may be utilized as the connecting means of a "building block" arrangement which uses the joining means or connectors to provide interconnected units which may or may not be functionally related. For example, the embodiment of FIG. 1 may be used to make a rack, table, or the like, and the ring structure of FIGS. 8 and 9 may be joined thereto by the joining means. As a consequence, a multiple purpose structure may easily be provided which will accommodate a variety of items for easy access or temporary storage.

The term "holder" as used herein shall mean any structure with which the joining means is integrally molded for attachment to another unit.

While the invention has been described in detail with reference to several embodiments thereof, it will be understood that this description is solely for illustrative purposes and is not in any way a limitation upon the scope of the invention as described in the appended claims.

I claim:

1. Joining means combination for securing articles together, including an assemblage comprising spaced joining members provided with a substantially vertically extending recess having an insertion throat portion and a body portion, a bar formed integral with and extending between the spaced joining members, the throat portion being narrower than the body portion, the spaced joining members comprising material endowed with a memory designed within the elastic limits of the material whereby the throat portion expands under pressure and returns to its original dimension when such pressure is removed, and a vertically disposed support unit having a substantially round cross sectional frame portion extending around a portion of its perimeter, the round cross sectional frame portion having substantially the same cross sectional configuration and dimension as the cross sectional configuration and dimension of the corresponding spaced joining member recess for accommodation with the recess.

2. Combination of claim 1 including a plurality of walls provided with corresponding round cross sectional frame portions extending around a portion of their perimeters, the spaced joining members extending between and engaging sides of the frame portions and being rotatable thereon, whereby the walls may be moved into substantially abutting relation with the spaced joining members remaining in engagement with the corresponding sides of the frame portions.

3. Combination of claim 2 wherein the spaced joining members are rotatable around the engaged portions of the frame portions, whereby upon disengagement of one of the spaced joining members from a corresponding frame portion the bar formed integral with the spaced joining members may be arcuately moved to provide access to the interior of the assemblage.

4. Combination of claim 1 wherein a shelf is integrally molded with and extends between the spaced joining members.

5. Combination of a utilitarian support member integrally molded with means for joining said support means in stabilized condition to a structure for supporting other articles comprising a joining member provided with a substantially vertically extending recess having an insertion throat portion and a body portion, the throat portion being narrower than the body portion, the joining member comprising material endowed with a memory designed within the elastic limits of the material whereby the throat portion expands under pressure and returns to its original dimension when such pressure is removed, a generally laterally extending utilitarian support member integrally connected directly locally to the body portion of the joining member, and a stabilizing bar depending from the utilitarian support member and integrally connected directly locally thereto in proximity to the body portion of the joining member, such that the body portion of the joining member, the utilitarian support member and the stabilizing bar are integrally interconnected at a substantially common interconnection directly locally therebetween for forming a one piece integral three member unit.

6. Combination of claim 5 wherein the laterally extending utilitarian support member is in the form of a ring.

7. Combination of claim 5 wherein the laterally extending utilitarian support member is in the form of a hook member.

8. Combination of claim 5 wherein the laterally extending utilitarian support member is in the form of a support bar.

9. Combination of claim 8 wherein the support bar has an upwardly directed flange at its outer extremety.

10. Combination of a utilitarian support member integrally molded with means for joining said support member in stabilized condition to a structure for supporting other articles comprising longitudinally spaced joining members provided with a substantially vertically extending recess having an insertion throat portion and a body portion, the throat portion being narrower than the body portion, the spaced joining members comprising material endowed with a memory designed within the elastic limits of the material whereby the throat portion expands under pressure and returns to its original dimension when such pressure is removed, a utilitarian support member having a longitudinal extent and corresponding longitudinal end portions and a lateral extent and corresponding lateral edge portions, the utilitarian support member longitudinally extending between the spaced joining members and being integrally connected at its corresponding end portions directly locally to the body portions of the spaced joining members, and further generally laterally extending crosswise of its longitudinal extent and of the spaced joining members, and longitudinally spaced stabilizing bars depending from the utilitarian support member and integrally connected directly locally to the corresponding end portions of the utilitarian support member in proximity to the corresponding body portions of the spaced joining members thereat and in laterally spaced relation to one of the lateral edge portions of the utilitarian support member, such that the body portions of the spaced joining members, the end portions of the utilitarian support member and the spaced stabilizing bars are correspondingly integrally interconnected at a respective common interconnection directly locally therebetween at each end portion of the utilitarian support member for forming a one piece integral five member unit.

11. Combination of claim 10 wherein the utilitarian support member is in the form of a horizontal tray.

12. Combination of claim 11 wherein the tray is provided with apertures therein.

13. Combination of claim 11 wherein the tray is provided with four corner portions at the corresponding marginal junctions between the longitudinal end portions and lateral edge portions of the utilitarian support member, and the common interconnections are disposed at two such corner portions adjacent one of the lateral edge portions.

14. Multiple joining means for securing article units together comprising a joining member provided with first and second substantially vertically extending stepped recesses communicating with each other and correspondingly including insertion throat and body portions, the stepped recesses having corresponding substantially parallel longitudinal axes extending in a direction crosswise of their substantially vertically extending stepped direction, the throat portion of the first recess being narrower than the body portion of the first recess, the second recess being of smaller dimension than the first recess, the throat portion of the second recess being narrower than the body portion of the second recess, and the joining member comprising material endowed with a memory designed within the elastic limits of the material whereby the throat portions correspondingly expand under pressure and return to their original dimension when such pressure is removed, whereby a relatively smaller sized longitudinal bar on one article unit will pass through the first recess and be accommodated and engaged in the second recess along the longitudinal axis of the second recess and in substantially parallel relation to the longitudinally axis of the first recess, and a relatively large sized longitudinal bar on another article unit will be accommodated and engaged in the first recess along the longitudinal axis of the first recess and in substantially parallel relation to the longitudinal axis of the second recess, such that when one such bar is engaged in one of the recesses and simultaneously another such bar is engaged in the other of the recesses the bars will be accommodated without interference with each other.

15. Joining means of claim 14 wherein there is a plurality of said joining members joined by a joining bar extending therebetween.

16. Multiple joining means for securing article units together comprising a plurality of longitudinally spaced joining members each provided with first and second substantially vertically extending stepped recesses communicating with each other and correspondingly including insertion throat and body portions, the stepped recesses having corresponding substantially parallel longitudinal axes extending in a direction crosswise of their substantially vertically extending stepped direction, such that the stepped first recesses have a common longitudinal axis and the stepped second recesses have a common longitudinal axis substantially parallel to the common axis of the first recesses, the throat portions of the first recesses being correspondingly narrower than the body portions of the first recesses, the second recesses being correspondingly of smaller dimension than the first recesses, the throat portions of the second recesses being correspondingly narrower than the body portions of the second recesses, the joining members comprising material endowed with a memory designed within the elastic limits of the material whereby the throat portions correspondingly expand under pressure and return to their original dimension when such pressure is removed, and a longitudinal joining bar extending between the plurality of joining members and joined thereto to form a one piece integral unit therewith in which the joining bar is disposed in substantially parallel relation with the common longitudinal axis of the stepped first recesses and the common longitudinal axis of the stepped second recesses, whereby a relatively smaller sized separate longitudinal bar on one article unit will pass through the first recesses and be accommodated and engaged in the second recesses along the common longitudinal axis of the second recesses and in substantially parallel relation to the common longitudinal axis of the first recesses, throughout the common extent of the smaller sized separate bar and the joining members along the joining bar adjacent thereto, and a relatively large sized separate longitudinal bar on another article unit will be accommodated and engaged in the first recesses along the common longitudinal axis of the first recesses and in substantially parallel relation to the common longitudinal axis of the second recesses, throughout the common extent of the larger sized separate bar and the joining members along the joining bar adjacent thereto, such that when one such separate bar is so engaged in the second recesses and simultaneously another such separate bar is so engaged in the first recesses, along a common coextensive extent, the separate bars will be accommodated without interference with each other.

17. Joining means of claim 16 wherein the joining bar is provided with a profile corresponding to the profile of the second recesses.

18. Combination of a utilitarian support member integrally molded with means for joining said support member to a structure for supporting other articles comprising a utilitarian support member in the form of the lattice of crossmembers having a perimeter, a top side and a bottom side, and a plurality of spaced joining members provided with a substantially vertically extending recess having an insertion throat portion and a body portion, the throat portion being narrower than the body portion, the spaced joining members comprising material endowed with a memory designed within the elastic limits of the material whereby the throat portion expands under pressure and returns to its original dimension when such pressure is removed, the spaced joining members depending from the bottom side of the lattice and being disposed inwardly of the perimeter thereof and being integrally connected at the corresponding body portions of the joining members directly locally to crossmembers of the lattice to form a one piece integral unit therewith.

19. Combination of claim 18 wherein the joining members are arranged in a plurality of rows of aligned joining members in spaced apart relation along the bottom side of the lattice.

* * * * *